United States Patent [19]

Drits et al.

[11] Patent Number: 4,873,605

[45] Date of Patent: Oct. 10, 1989

[54] MAGNETIC TREATMENT OF FERROMAGNETIC MATERIALS

[75] Inventors: Vladimir Drits, Minnetonka, Minn.; Naum Tselesin, Atlanta, Ga.

[73] Assignee: Innovex, Inc., Hopkins, Minn.

[21] Appl. No.: 1,950

[22] Filed: Jan. 9, 1987

Related U.S. Application Data

[63] Continuation-in-part of Ser. No. 835,462, Mar. 3, 1986, abandoned.

[51] Int. Cl.[4] ..... H01F 13/00; H01H 47/00

[52] U.S. Cl. ..... 361/143; 148/108; 361/149; 361/267

[58] Field of Search ..... 361/143, 149, 267; 335/284; 148/108; 29/DIG. 95

[56] References Cited

U.S. PATENT DOCUMENTS

| | | | |
|---|---|---|---|
| 1,978,220 | 10/1934 | Otte | 148/108 |
| 2,984,771 | 5/1961 | Hlavin | 361/149 |
| 2,995,701 | 8/1961 | Lloyd | 324/37 |
| 3,138,494 | 6/1964 | Burket et al. | 148/108 X |
| 3,819,402 | 6/1974 | Thrower, Jr. | 117/93.1 DH |
| 3,892,908 | 7/1975 | Lovness | 428/329 |
| 3,946,125 | 3/1976 | Scheiber | 427/46 |
| 3,963,533 | 6/1976 | Collins | 148/108 |
| 4,033,795 | 7/1977 | Berry et al. | 148/108 |
| 4,212,688 | 7/1980 | Makino et al. | 148/31.55 |
| 4,262,035 | 4/1981 | Jaeger et al. | 427/39 |
| 4,268,325 | 5/1981 | O'Handley et al. | 148/108 |
| 4,273,800 | 6/1981 | Reid | 427/47 |
| 4,283,438 | 8/1981 | Lee | 427/47 |
| 4,379,004 | 4/1983 | Makino et al. | 148/108 |
| 4,419,383 | 12/1983 | Lee | 427/47 |
| 4,473,415 | 9/1984 | Ochiai et al. | 148/108 |
| 4,492,845 | 1/1985 | Kljuchko et al. | 219/121 P |
| 4,537,850 | 8/1985 | Smeiman | 430/137 |
| 4,551,221 | 11/1985 | Axemov et al. | 204/298 |
| 4,560,521 | 12/1985 | Walling et al. | 264/24 |
| 4,639,278 | 1/1987 | Makino et al. | 148/108 |
| 4,668,365 | 5/1987 | Foster et al. | 204/192.23 |

FOREIGN PATENT DOCUMENTS

| | | | |
|---|---|---|---|
| 56-44746 | 4/1981 | Japan | 148/108 |
| 60-26647 | 2/1985 | Japan | 148/108 |
| 62-5989 | 2/1987 | Japan | 148/108 |
| 485155 | 12/1975 | U.S.S.R. | 148/108 |
| 2047005 | 11/1980 | United Kingdom | 361/143 |

OTHER PUBLICATIONS

L. M. Romashov et al., "Effect of Pulse Magnetic Filed on Martensitic Transformation in Low Carbon Cr-Ni Steel," *Fisica Metallov and Metallovedenie,* 1984, 57 v. 4 (in Russian).

V. M. Finkel, "Physical Foundations of Failure Retardation", Moscow, "Metallurgiya" Publishers, 1977 (translated from Russian).

*Primary Examiner*—Michael L. Gellner

*Attorney, Agent, or Firm*—Kinney & Lange

[57] ABSTRACT

A device for treatment of ferromagnetic materials comprising means for developing a magnetic field of a selected intensity, duration, and cycle, which field is passed through materials to be processed, such as cutting tools and drill bits that have been sharpened or resharpened and other parts that have internal stresses. The magnetic field through the material provides stress relief of the stresses from welding, forming, heating cooling or sharpening or loading. The treatment increases surface wear resistance, decreases the coefficient of friction on the surfaces that are so treated, and increases the strength and modulus of elasticity. In certain types of materials, an increase in the surface concentration of such alloying metals such as wolfram, molybdenum, and tungsten, as well as oxygen and carbon is achieved. The structure comprises a coil and a controlled source of electrical power that generates a magnetic field for achieving the desired results.

26 Claims, 3 Drawing Sheets

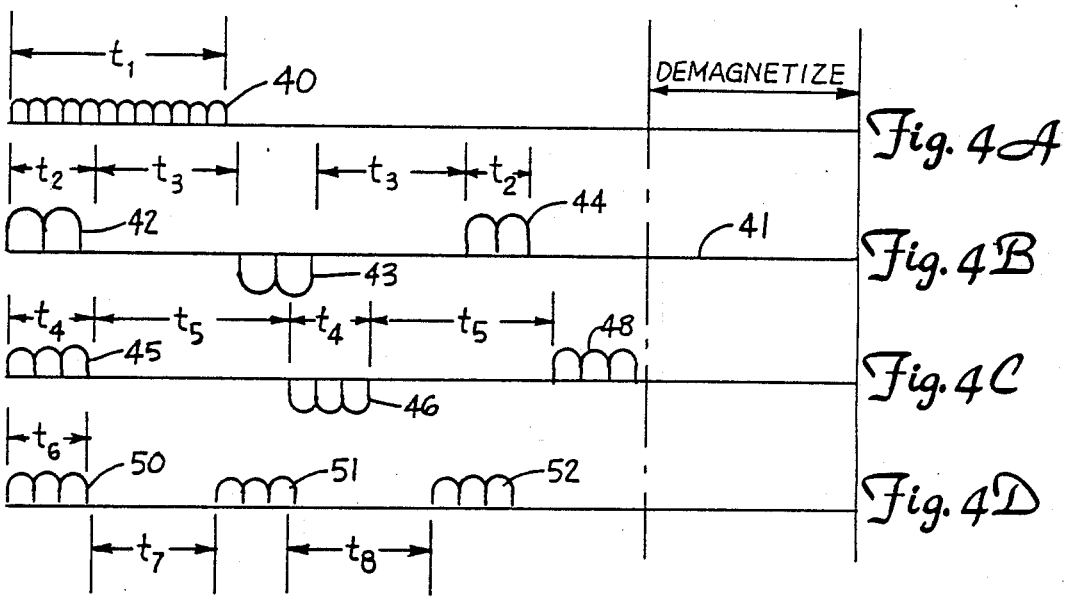
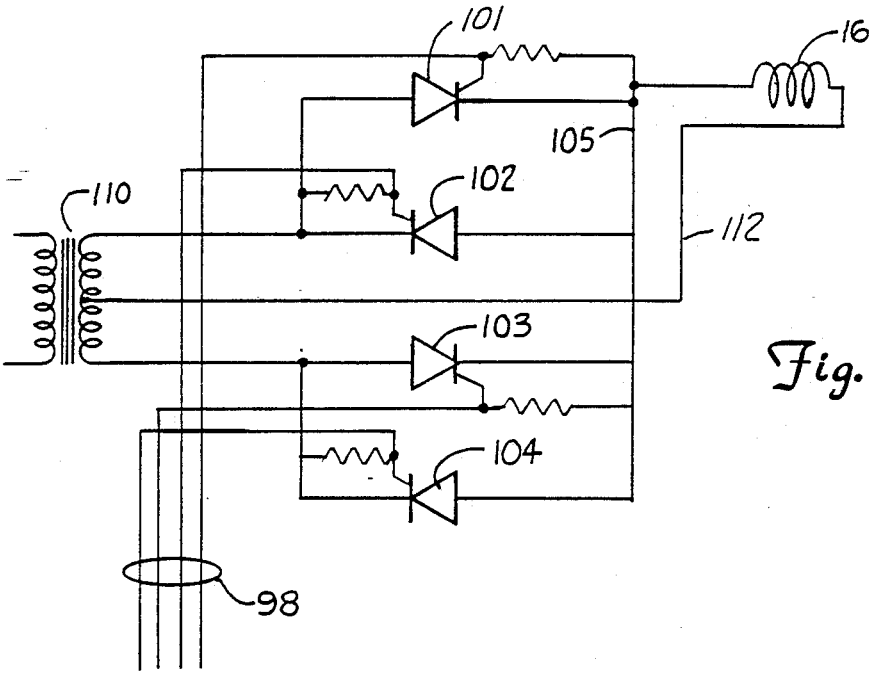
Fig. 7

MAGNETIC TREATMENT OF FERROMAGNETIC MATERIALS

CROSS REFERENCE TO RELATED APPLICATION

This application is a continuation-in-part of U.S. patent application Ser. No. 835,462, filed Mar. 3, 1986 for DEVICE FOR TREATMENT OF CUTTING TOOLS, now abandoned.

BACKGROUND OF THE INVENTION

1. Field of the Invention

The present invention has a relation to treatment of materials utilizing magnetic fields.

2. Description of the Prior Art

Magnetization and the effect of magnetic fields has been explored in various applications. However, up to now treatment for increasing the life of metal parts including cutting tools has not be advanced. Stresses can be caused by many factors, such as welding, heat treating, forming or sharpening. For example, machine tools that have been sharpened will have internal stresses on their edges which start breaks or chips. Previously items were annealed or otherwise treated for stress relief, but not using magnetic fields.

SUMMARY OF THE INVENTION

The present invention relates to an apparatus and method of treating magnetic field affected objects and materials, for example ferromagnetic parts and materials and material containing ferro magnetic components such as machine tool bits to prolong life by subjecting the material to a magnetic field during a selected time cycle to redistribute stresses to reduce highly stressed areas.

The magnetic field through the material such as a tool provides relief of the stresses from sharpening, increases strength and surface hardness, decreases the coefficient of friction on the surfaces that are so treated, provides an increase in the modulus of elasticity, strength and wear resistance and in certain types of metals, provides a change in the surface concentration of such alloying metals such as wolfram, molybdenum, and tungsten, as well as oxygen and carbon.

The structure comprises a coil into which the part or material to be treated is inserted, and a controlled source of electrical power that generates a magnetic field on the interior of the coil for achieving the desired results.

It has been determined that magnetic treatment of ferromagnetic materials, even at room temperature, affects mechanical and service properties of piece parts, including machine tool bits, as well as other products. Magnetic treatment is used for new, enhanced methods for non-cutting tool applications. In metals, the magnetic domain walls have a barrier action on movement of dislocations in the material. Intense change in the magnetic pressure causes the domain walls to move at room temperature, and such fluctuation of the domain walls results in a type of a "relay race" rearrangement of dislocations and microstresses from local overstressed areas to neighboring areas of the part. This results in more uniform distribution of internal stresses in various parts. The result of treatment can be considered to be equivalent to partial thermal stress relief (recovery), tempering or aging. Microstresses also can be created by magnetic treatment.

By proper programming, generally at programed cycles that are arrived at as shown in this application, and by using the appropriate frequency, amplitude and density of pulsing magnetic field, the treating of powdered metal materials and metal consisting composition both prior to green forming, in the green formed state and both during and after sintering, both in the process and after heat treating of sintered parts, both in the process and after sizing, forging, recompacting, shaping of sintered or half sintered parts, it is possible to reduce internal stresses, and improve compactability (which makes it possible to press more sophisticated shapes and more dense parts) and to decrease the spring-back effect. Prior to green forming, magnetic treatment improves homogenity of powder particles (for example in a process of the atomization of powder) and reduces cold working (for example, after milling). In green compacts of powdered materials, magnetic treatment decreases non-uniformity of density, reduces cold working, reduces residual stress, non-uniformity of stress and reduces the required compacting pressure. In the sintered parts magnetic treatment relieves and redistributes cold working and residual stresses.

By decreasing the spring-back effect in green powdered metal compacts and reducing crack propagation. Both in green compacts and sintered parts it is possible to obtain a more uniform distribution of internal stresses and thus better life and better operation of the part.

Additionally, magnetically treating heat treated parts, such as machine tool bits and other heat treated parts, prolongs the useful life of the part by subjecting the part, such as a tool bit, to a magnetic field during a selected time cycle to redistribute stresses and to reduce stress in highly stressed areas.

It is apparent that the pulsing magnetic field that is useful for machine tool stress reducing also can be used in other stress reducing applications such as welding, brazing and soldering to prevent distortion and/or cracking of the parts that are subjected to these processes. The magnetic field can be applied before, during or after joining, or during all three times. Material subjected to magnetic treatment before welding, or other joining operations involving heat has better weldability or ability to be joined because of lower residual stresses. Treatment during the process of welding, soldering or brazing increases the amount of grain nucleus, improves the diffusion processes, limits the growth of grains, and relieves the stress between joints.

Magnetic treatment of cold welded parts, or parts which are in the process of cooling, decreases the level of residual stresses.

Machine tool treatment aids in reducing of stress in the tools and treating the part helps machinery. For example, treating ferrites and similar brittle, ferromagnetic materials with a magnetic field reduces the problems of chipping of the ferrite in areas where the tool enters and exits, which are the regions where the dynamic input of a grinding tool, for example, is most significant.

Further, deep drawing metal also involves substantial stresses in both the tools and the work piece, and proper magnetic treatment during the deep drawing operation with a magnetic field that passes through the work piece keeps the stress levels low and aids greatly in reducing fractures and damaged and lost parts.

It does become apparent that treatment of tools and/or parts during machining and/or heat treating, cooling and other normally conducted material treatment reduces the distortions due to residual stresses, and will reduce cracking of castings or powdered metal materials, as well. The same is true if bending, twisting or truing operations are being carried out, and doing this in the presence of a magnetic field.

BRIEF DESCRIPTION OF THE DRAWINGS

FIGS. 4A to 4D are schematic representations of typical power cycle time lines that have been found useful with the present device;

FIG. 7 is a schematic representation of a SCR power control used with the present invention;

DETAILED DESCRIPTION OF THE PREFERRED EMBODIMENT

Figure 1:
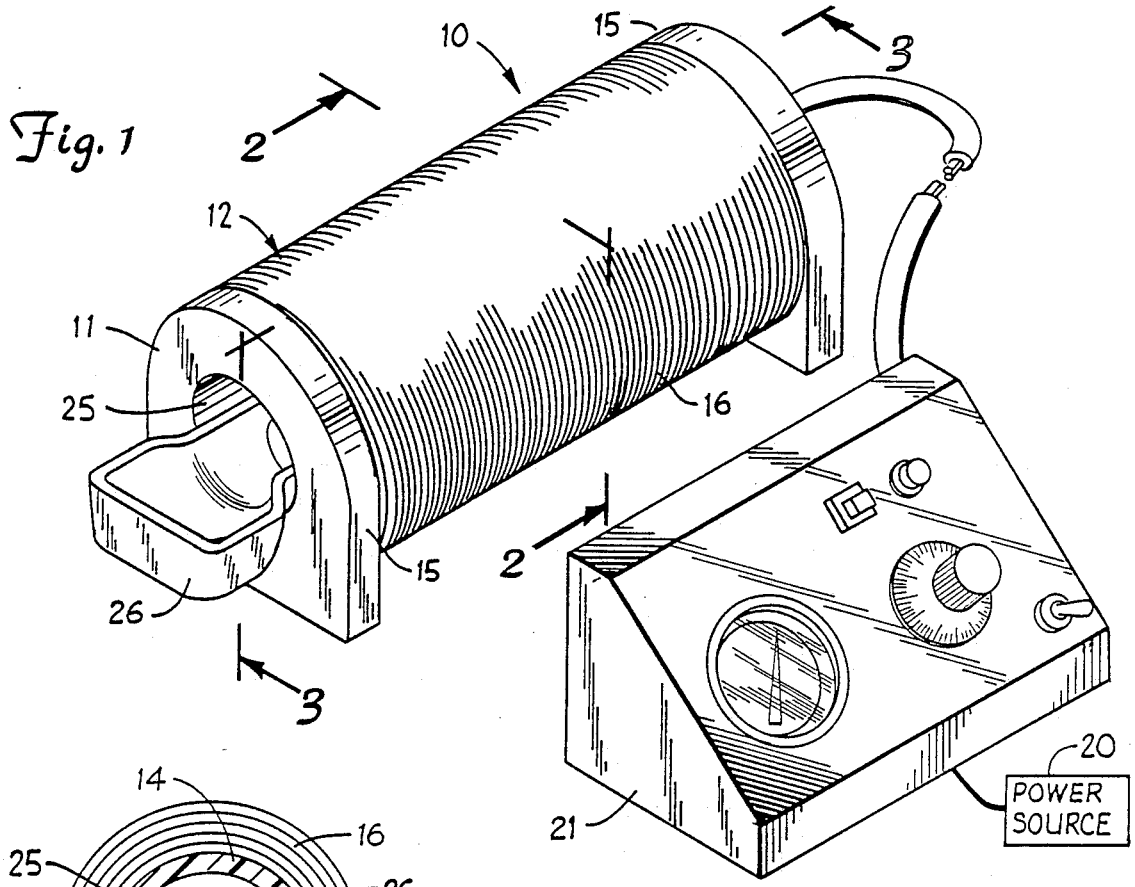
FIG. 1 is a perspective representation of a device made according to the present invention showing a tool holding tray in position within an inductive coil.
Figure 2:
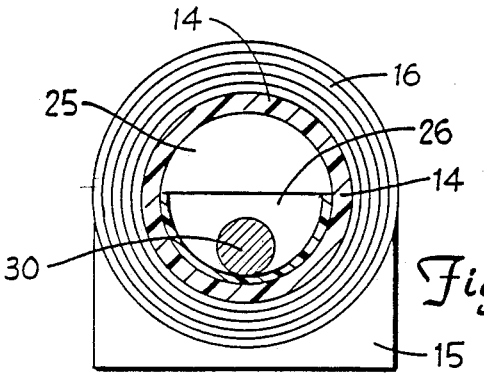
FIG. 2 is a vertical sectional view of the device of FIG. 1 taken on line 2—2 in FIG. 1.

A material treatment device made according to the present invention is indicated generally at 10 and comprises a frame 11, on which a coil assembly 12 is mounted. The coil assembly 12 as shown has a central core 14 and end flanges 15. A coil 16 of suitable wire, and having the necessary number of turns is wound on core 14 between flanges 15. The coil 16 is connected to a power source 20 that provides a reversing DC voltage and thus, current, to the coil at a desired level and frequency, through a control shown at 21. The parameters can be varied through the use of the controller 21. The power source preferrably has a SCR controlled output and the controller that permits the application of power at a desired frequency, average voltage level and duration.

The core 14 has an internal opening 25, in which a tool holding drawer 26 is mounted. The drawer 26 can be of any desired configuration, but generally is of nonmagnetic material, so that the magnetic field generated by the coil will pass through a tool or other material indicated at 30. The tool 30 shown is a tool that has recently been sharpened, and may have internal stresses.

The controller 21 is operated to provide a power cycle through the coil, to create a magnetic field through the tool, and this magnetic field, depending on the number of cycles, the length of pauses between cycles, if the cycles are repeated, and the amplitude or power of the magnetic field, will be used to treat the tool. The cycle length is usually about 15 seconds up to 50 seconds, but the waveform can be varied within the cycle time in order to obtain the desired results. Experimentation for particular tool size and material can be carried out for typical applications.

Referring to FIGS. 4A–4D, the plots of typical types of magnetization cycles are shown.

In FIG. 4A, the power cycles or magnetic field cycles shown at 40 are of relatively low magnitude (time is to the right and voltage level, and thus current, since $E=IR$, is vertical), relatively high frequency, and of a continuous duration for the time $t_1$. This will provide a steady state magnetization, at a relatively low level for the part.

In FIG. 4B, a different type of cycle is shown. Again, voltage is on the vertical scale with the line 41 being zero, and the cycles below the line indicating a reversal of power. In this instance, the frequency is reduced, and the first cycle indicated at 42 is only of two half cycles for a time $t_2$, then there is a pause for a time indicated at $T_3$, another reversal of power cycle 43 is shown. Finally, if desired a third cycle 44 can be identical to that shown at 42. The pause time $t_3$ would be repeated between cycles 43 and 44.

In FIG. 4C, a higher frequency cycle is shown at 45, with a cycle time $t_4$ and a longer pause time $t_5$ between the reversal of cycles when the reverse cycles 46 are used. After an additional pause time $t_5$, an identical cycle indicated at 48 is applied. FIG. 4D shows another variation, where the power is of higher frequency as indicated at 50 and the on time is $t_6$. The pause time $t_7$ is of less duration, and the same number of cycles are repeated at 51 and 52, without any reversal of magnetic field. Further, the time $t_8$ can be different than the time $t_7$. The time for applying cycles 51 or 52 may also be different from the time of cycle 50.

Figure 5:
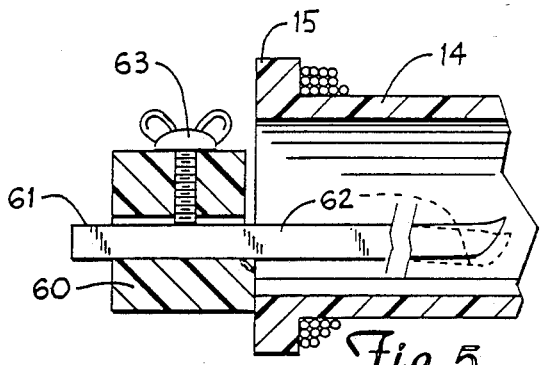
FIG. 5 is a cross sectional view of a modified part holder used with the device of the present invention.
Figure 3:
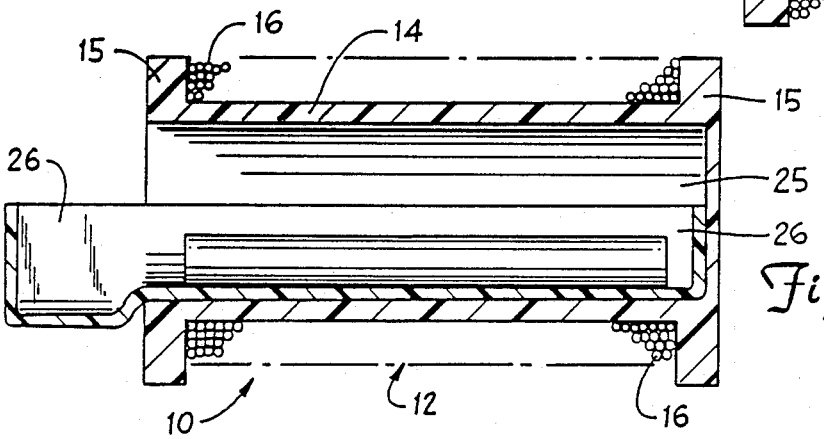
FIG. 3 is a sectional view taken on line 3—3 in FIG. 1.

It should be noted that preferably the drawer or tray 26 is of nonmagnetic material, but preferably heat conducting. Bronze material has been found acceptable and as shown in FIG. 5, the tray indicated there at 60 can be modified to include an opening 61 at one end that receives a tool 62 and a set screw 63 threaded into the outer end member of the tray can be used to tightly clamp the tool 62 in place so that when the magnetic field is applied, the tool may be bent slightly or changed in position, as indicated in exaggerated form by the dotted lines in FIG. 5. Magnetic bending of materials in sufficiently powerful magnetic fields is known. However, treating a machine tool bit as shown, has not been used for relieving stresses as a function of and directly related to magnetostrictive forces.

Figure 6:
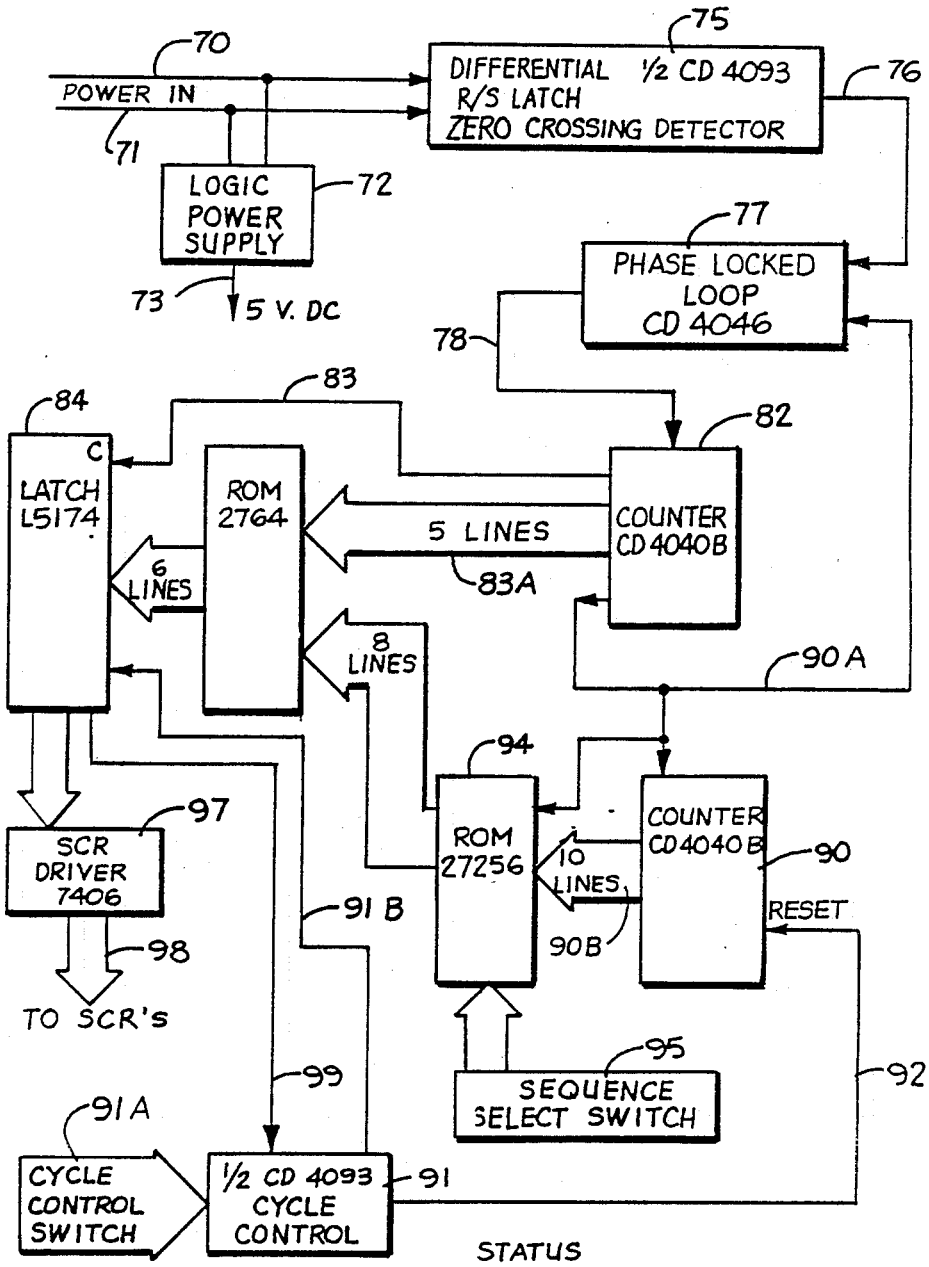
FIG. 6 is a schematic representation of typical controller that can be used for providing varying power levels and timing of power to the device of the present invention.

FIG. 6 shows a typical timer and sequencing circuit that can be varied for forwarding signals to the gates of silicon controlled rectifiers for providing power. SCR controllers are well known, and any desired controller may be used. Many commercial controllers provide adjustable timing of on-off cycles, frequency and voltage outputs that can be used to supply current to the coil 16.

Power source 20 provides an output along lines 70 and 71, respectively (usually 28 volts AC). A logic power supply indicated at 72 is used for providing a five volt DC output along a line 73 for the logic circuits that are used. A one half of a zero crossing detector circuit CD4093 indicated at 75 is provided to provide output along line 76 each time the input power crosses zero, and output signal is fed to a phase locked loop circuit, for example integrated circuit CD4046, indicated at 77. The output signal from the circuit 77 along line 78 is provided at 128 times line frequency in the form shown, to provide an adequate range of control frequencies. The output frequency signal is provided to the clock input of counter 82, which is a CD4040B counter. Counts are provided along a clock frequency line 83 from counter 84, which is 64 times the line frequency to the clock input of a latch circuit 84, type LS174. Five output signals at different frequencies (32, 16, 8, 4 and 2 times line frequency) are provided to a ROM indicated at 85 (a 2764 ROM is suitable) along a bus 83A. The ROM provides control signals along a six line bus 85A to the latch 84. A second counter 90 is provided with a start signal from a cycle control circuit which is one-half of a CD4093 circuit indicated at 91. The start switch (part of cycle control switch indicated at 91A) is manually set to provide the start signal on line 92. The clock input counter 90 is connected to a phase locked line 90A that is at input line frequency. The outputs from the second counter 90 are fed to a second ROM 94. The bus 90B has 10 lines and provides counts of 1, 2, 4, etc. The input sequence select switch 95 is set (four sequences as shown in FIGS. 4A–4D typically are provided), to control the frequency of the output and the number and length of pauses and power on cycles that are to be provided.

The output of the ROM 94 are provided to the input of ROM 85, which is programmed to provide the output signals on bus 85A to the latch 84. The output of the latch goes to the 7406 circuit 97 comprising the SCR drivers 97. The outputs along a bus 98 goes to the gates of four SCR's used in a conventional manner to provide the output configurations as shown in FIGS. 4A–4D.

The ROM's can be programmed in a known manner to select which SCR is triggered and the frequency at which they are triggered, so that various power configurations can be achieved.

One type of SCR arrangement is shown in FIG. 7, schematically, and as each of the signals is provided along the bus 98, the signals to the gates of the respective silicon controlled rectifiers shown at 101, 102, 103 and 104 will provide for conduction of power to or from a line 105 that leads to one end of the coil 16. The power is from a 24 volt transformer indicated at 110. The center tap is along a line 112 leading to the opposite end of the coil 16 and by the proper sequencing of the gates in a normal known manner the cycling of the current to the coil can be obtained. The transformer can provide power to lines 70 and 71 as well.

The nominal 24 volt power is controlled by the SCR's in time duration so that basically a reversing, DC level of approximately 12 volts (rms) is provided through the coil 16. The current is of course proportional to the coil resistance and input voltage. The timing of the control current through its complete cycle until the "complete" signal is received along a "cycle done" line 99 back to the cycle control 91 will range from 15 to 50 seconds.

It should be noted also that the cycle control 91 can provide a shut off button through the manual control switches 91A so that a disable signal along 91B is provided to the latch 84 to prevent output power from being provided when the operator decides it is necessary.

Pulse durations provided from the SCR's can range from about 16 milliseconds, to about 120 milliseconds. Because the ROMs can be programmed, various settings and cycles for operating the latch 84 and thus sequencing the signals to the gates of the SCR's can be made. Additionally, as shown in FIGS. 4A–4D there is a degausing or demagnetization portion to the cycle, and this is represented by the vertical lines at the right end of each cycle. The SCR's can be controlled to reduce the voltage (and thus current) amplitude and also reverse the direction of the voltage and current, to provide the demagnetization if desired. Commercial degausing circuits are also available at the present time. The tool can be removed from the tray and then demagnetized as desired.

The size of the tool has a significant impact on the length of and type of power cycle chosen. For example, in general a one-quarter inch steel bit can be cycled at the sequence shown in FIG. 4A, for about three seconds, or one-fifth of a 15 second cycle time. It would receive a steady magnetization, and then could be degaused by reversing the direction of current, and decreasing the current to zero during the short degausing cycle.

It has been shown that when steel is magnetized, its modulus of elasticity is raised, and thus it becomes more rigid. This provides for less likelihood of deflections and provides for increased machining efficiency as well as longer tool life. Therefore, the present invention comtemplates leaving tools magnetized after the treatment for stress relief. Such tools would be for cutting non-magnetic materials, such as plastics or non-ferrous metals. When a magnetized tool is used with magnetic materials, the chips will cling to the tool.

By of example, a coil core having a two and one-half inch internal diameter has been wound with 600 turns of No. 11 square wire, and powered with about 12 volts rms, pulsing DC, through the SCR's to provide current that forms an adequate magnetic field for magnetization treatment of machine tool bits up to about two inches in diameter.

The term "machine tool bit" as used herein means a drill bit, a cutting tool for a lathe, or other tools that are to be used for working on parts for removing material from the part.

Stresses in such cutting tools are caused by contacting with machined material and sharpening or resharpening the tools in an uncontrolled atmosphere, and in particular, the thin edge of the tool is often overheated in spots. This heating is usually accompanied by overstress.

Wearing, cracking or chipping of the cutting edge as a rule starts in the area of the overstress, and by redistribution of the stress (making it more uniform or decreasing it), the tool life can be increased significantly. While stress relief is known by way of heat treatment in an oven, mechanical vibration, cryogenic treatment, or laser or annealing, the present device uses magnetostriction, by generating a magnetic field through the magnetic material of the cutting tool. This can be used for ferrous materials, crystals and component materials. The tool is subjected to multi-directional forces during magnetostriction treatment or the magnetic treatment process of the present invention, and this provides for stresses along the surface, and most importantly along the cutting edge.

Since the stresses are a function of magnetization, which in turn is a function of the applied magnetic field and that in turn is a function of the current in the coil being used, the magnetization and the relieving stresses can be controlled by monitoring the voltage level applied to the coil and by regulating the timing of the field as to intensity, duration and frequency.

Variability of the field as described is to accomodate a variety of different tools. Generally speaking, the larger the tool the longer the treatment time that is required, and the greater current that would be applied.

In regard to the device shown in FIG. 5, the bending action is achieved by placing the tool at a location other than the axis of a coil, and then holding it securely. This means that the tray head portion where the set screw is mounted has to-fit on the interior of the coil tightly, so it will not shift. It, too, can be clamped tightly in place if desired.

It is to be understood that the controls previously shown in FIGS. 1–7, can be utilized with any of the following applications of the magnetic treating apparatus, wherein the benefits have been recognized as providing stress relief in metal and metal consisting objects.

Figure 8:
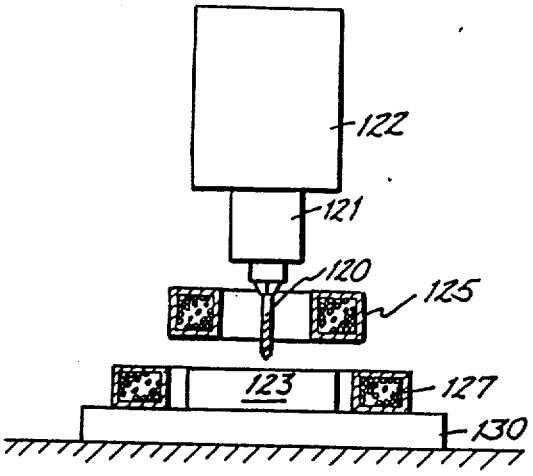
FIG. 8 is a schematic representation of a typical drill bit in use with a work piece, and showing magnetic field producing means surrounding the drill bit itself, and also the work piece to provide magnetic fields during operation.

In FIG. 8, a cutting tool comprising a drill bit shown at 120 is mounted in a chuck 121 of a drill head 122, and when powered, the drill is rotated and is used for drilling holes in a work piece 123 that, as shown schematically, is supported in position below the bit.

Treatment of the drill bit may be achieved by providing a magnetic coil 125 that surrounds the drill bit in its path so that the drill is subjected to a magnetic field when the drill is retracted as shown in FIG. 8, and also during the period of time that the drill operates in the work piece.

Thus, the benefits of stress relief in the drill bit are actually achieved during operation of the drill bit. Further, the part 123 itself, which can be of suitable metal, is positioned within a ring type coil 127 that provides a magnetic field through the work piece of suitable intensity or duration, or even a pulsating field as previously described may be used to help in reducing the stresses in the work piece during the drilling operations (or other machining operations).

As was previously pointed out, this treatment of the machine tool bit increases the tool life, maintains the sharpness for a longer period of time, and prevents unnecessary down time.

Another method of treating the part 123, particularly if it is a part such as a ferrite or similar brittle ferromagnetic material can be achieved with a permanent magnet or an electromagnet used to hold the part. The piece part support indicated generally at 130 is made up of a strong permanent or electromagnet, which will not only hold the piece part 123 in position, but also will provide a magnetic field that is applied before, during and after the machining operations. The magnetic field is maintained at a high enough level throughout the machining to ensure that the part does not slip or move. This greatly enhances the machineability of ferrites and other brittle materials. A magnetic field being applied to the part during work ensures that stresses are kept at a minimum.

Figure 9:
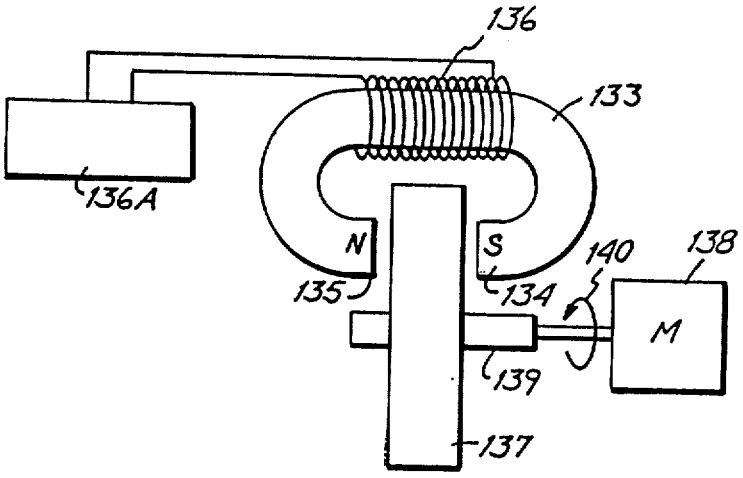
FIG. 9 is a schematic representation of a different form of magnetic field generating means for a rotating part that is being machined, or ground, wherein the part can be treated as it is being machined.

FIG. 9 is a modified form of the invention, comprising a yoke 133 that has a north magnetic pole 134, spaced from a south magnetic pole 135, and which yoke can be provided with a coil 136 connected to a power supply 136A for providing the magnetic field. The spaced apart poles 135 and 136 permit positioning a rotating piece part 137 therebetween, so that a magnetic field is applied as the piece part 137 rotates under control of a motor 138 that rotates a support shaft 139, for example, in the direction shown by the arrow 140. A grinding wheel or similar tool (for example, saws for cutting stones or concretes) can be used on the surface or periphery of the work piece 137 at the same time the work piece is rotated, and the work piece thus is subjected to a magnetic field while it is being worked on to minimize the problems from internal stresses and make the stresses uniform. For powdered metal parts, the presence of a magnetic field reduces the chipping or breakage during operation of the machine tool.

Figure 10:
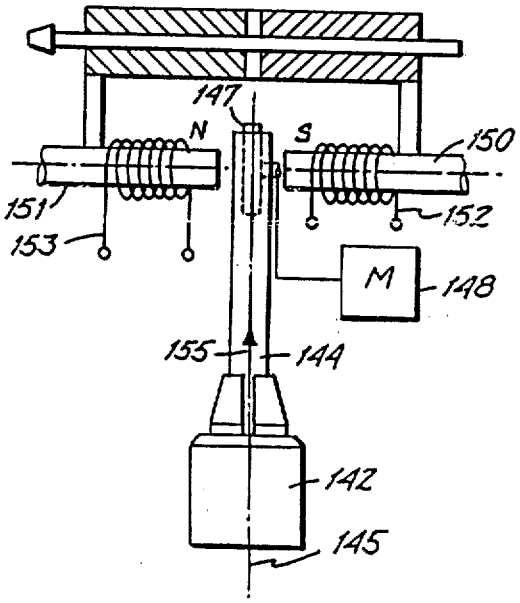
FIG. 10 is a schematic representation of a rotating part held in a schematically shown chuck and which is rotated between separate electromagnets supported adjacent one end of the part, and showing a grinding wheel schematically in position for grinding the parts.

In FIG. 10, a further modified form of the invention is shown, wherein a chuck or other tool holding part 142 is holding a cylindrical part 144 that will be rotated about the longitudinal axis 145 of the chuck and the part. A grinding wheel 147 is provided to engage the outer surface of the part and is driven with a motor 148 at the same time that part 144 is rotated. In order to aid this type of operation, again when the part is a brittle material, a pair of spaced apart pole pieces 150 and 151, which have coils 152 and 153 thereon can be provided for forming north and south magnetic poles on opposite sides of the part 144 to form a magnetic field that treats the part. A suitable power source is used for the coils to obtain the desired magnetic field. If there is movement of the part along the axis in the direction that is indicated by the arrow 155, the introductory ends of the part will be treated with a magnetic field as it is introduced into the grinding tool, and this ensures that any tendancy for fracture or clipping of the part is minimized.

Figure 11:
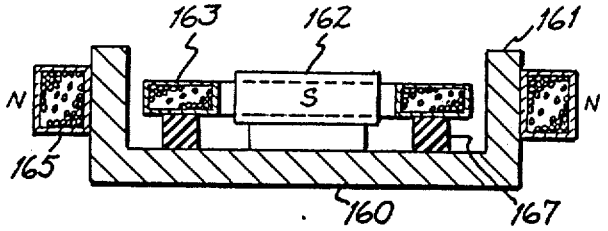
FIG. 11 is a further modified form of a magnetic field generating means schematically shown to show the treatment of a ring type part.

FIG. 11 shows a cup shaped magnet which can be used for treating toroidal parts, either for stress relief after heat treatment or for other types of treatment, for example, after welding, brazing or soldering; and this cup shaped magnet 160 has a peripheral wall having an edge 161 that comprises a north pole, and a center piece 162 that comprises a south pole. A toroidal or annular part 163 can be slipped into the cup portion and supported in suitable supports 164 for subjection to a magnetic field. If desired, suitable coils such as that at 165 can be used for enhancing the magnetic field as desired. This type of arrangement can be used easily with parts that are already formed, and can be adapted for supporting parts that are being worked on with machine tools, as well.

Figure 12:
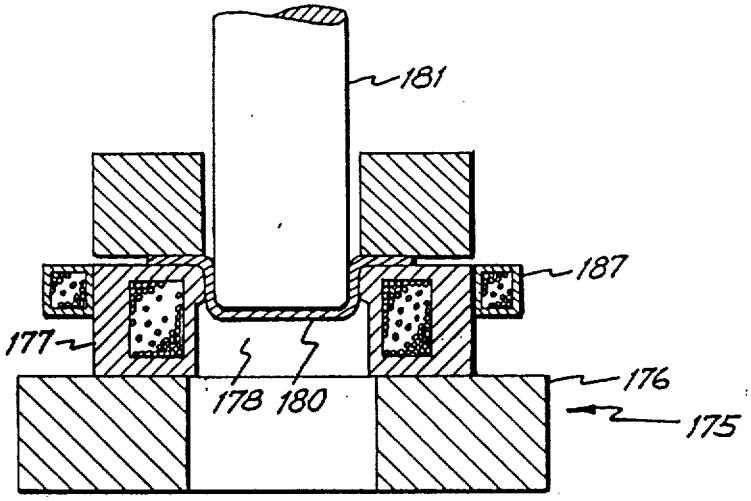
FIG. 12 is a schematic representation of a magnetic treatment for tools and parts during a deep draw operation.

In FIG. 12, a deep drawing die 175 is shown, and includes a die base 176, and a die 177 that is supported on the base. The die 177 has a central opening 178 into which a work piece, comprising a flat metal blank 180 is formed with a punch 181 in a conventional manner. The part is held at its periphery, and is drawn into the die opening 178 for forming into a cup for example. A magnet coil 182 can be provided around the die base to provide a magnetic field that will affect (act on) the work piece 180 when it is positioned on top of the die base, and will also provide a magnetic field through the die 177 and the work piece as it is being formed to keep stresses to a minimum in the die 177. Also another coil can be added to treat the die 177 and punch 181 in the process if application to reduce stresses. The coil 182 can be located where desired.

Figure 13:
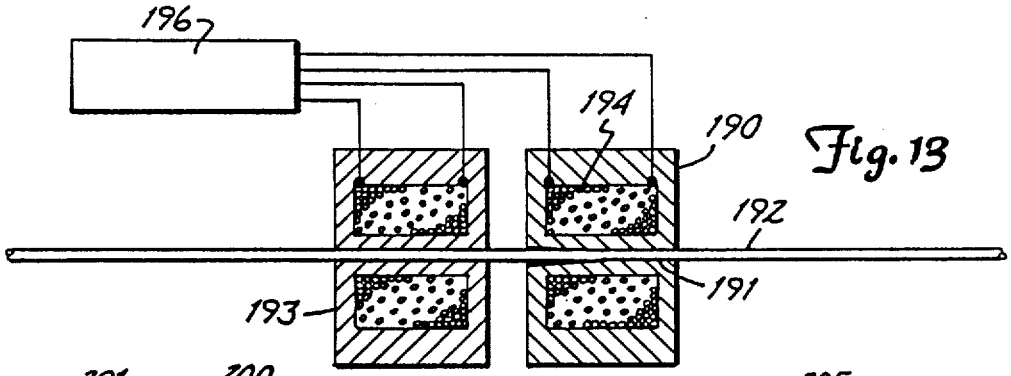
FIG. 13 is a schematic representation of a wire die showing magnetic field generating means built into the die for treating the wire as it is being formed, and also prior to formation.

FIG. 13 shows a similar device schematically for a wire drawing die wherein a die 190 has a draw opening 191 therein, through which a wire 192 can be drawn in a suitable manner. The magnet treatment comprises providing a coil 193 surrounding the wire on the input end of the die, and also providing a coil 194 around the die itself to ensure that the magnetic field will operate not only to anneal or reduce stresses in the wire prior to forming, but also during the forming process. Another coil can be added at the exit of the die to treat the drawn wire.

Suitable controls such as that shown at 196 which are similar to those previously described can be provided to select one or the other of the coils for operation at any time, or both of the coils can be selected for simultaneous operation, as well.

Again, the magnetic field is used for reducing internal stresses in the wire, and ensuring that the drawn wire is not under high internal stresses. The magnetic field also is used for reducing internal stresses accumulating in the die.

Figure 14:
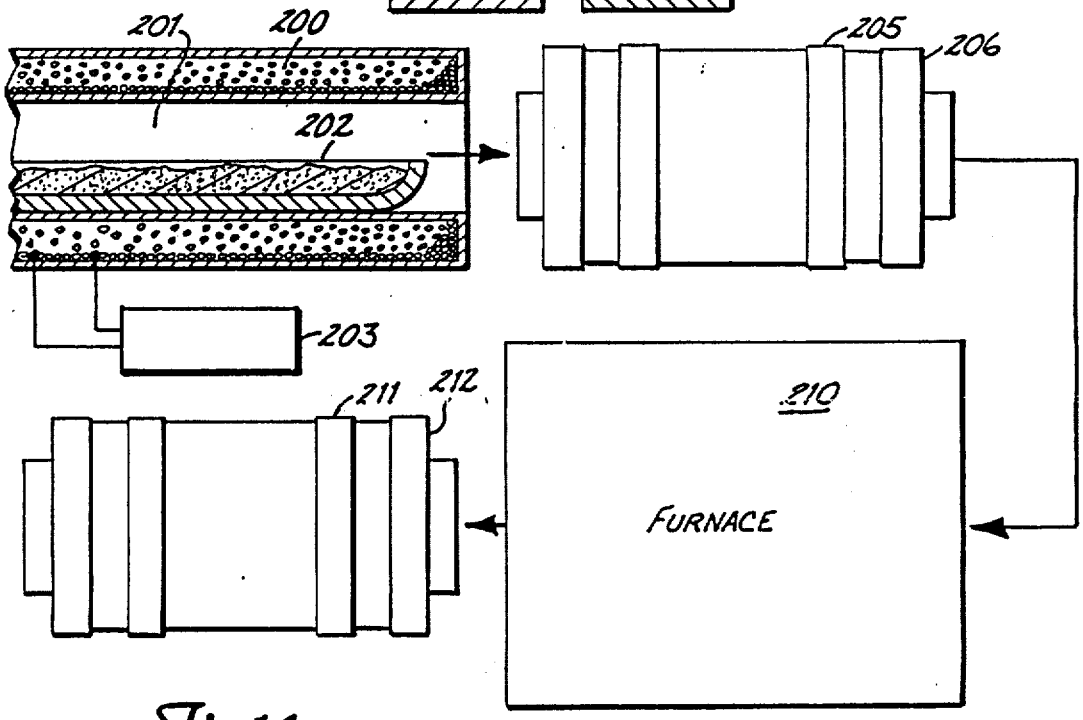
FIG. 14 is a schematic flow diagram of treating powdered metal parts, including prior to formation, as a green compact of a part, and after sintering.

FIG. 14 schematically shows another typical process for handling powdered material and composite parts. A coil housing indicated at 200 is provided with a central opening 201, into which a tray 202 can be placed, and then the coil can be powered from a suitable power source 203. The tray 202 is filled with powdered material shown at 204, which is in particle form for initial treatment, to reduce stresses in the metal particles through the provision of the magnetic field similar to that shown at FIGS. 1-3. This tray of course can be any desired size or shape, including a moveable baign for a continuous process to accomodate the amount of materials necessary to be treated. Also, the powder can flow (free or under some external action) through an included or vertical magnetic field process.

The powdered metal particles can then be formed into a green compact sleeve type member such as that shown at 205, in the process, and provided inside of a toroidal or annular coil 206, which can be suitably powered to provide a magnetic field that reduces the stresses on the green compact. The treating of the compact also improves its compactability, particularly if the magnetic treatment process is carried out while the powdered metal is being compacted.

The use of the magnetic field for the powder is valuable for improving compactability, so that more sophisticated shapes can be formed. The magnetic field treatment also decreases the spring-back effect. The residual porosity is decreased in the green compacts when treating as shown, within a toroidal core 206.

After treatment, the green compact is sent to a furnace 210 for sintering. The part then can be taken out, and as shown at 211, placed in a toroidal core 212 that will treat the sintered part to relieve and redistribute residual stresses, to simplify machining or further compacting, and to in general enhance its working properties. The part can be treated effectively at elevated temperatures, so the coil 212 can be in an oven or adjacent a heater to raise the temperature of the part to a desired level. Also, heating the powdered metal before compacting while treating it with the magnetic field is beneficial. For example, heaters and controls 225 can be provided with sensor 226 adjacent any part treated, including drill bits as shown schematically.

The heater 225, when used will bring the temperature of the parts to between 200° and 400° C normally, with temperatures up to 600° C. in special situations and for special materials.

Figure 15:
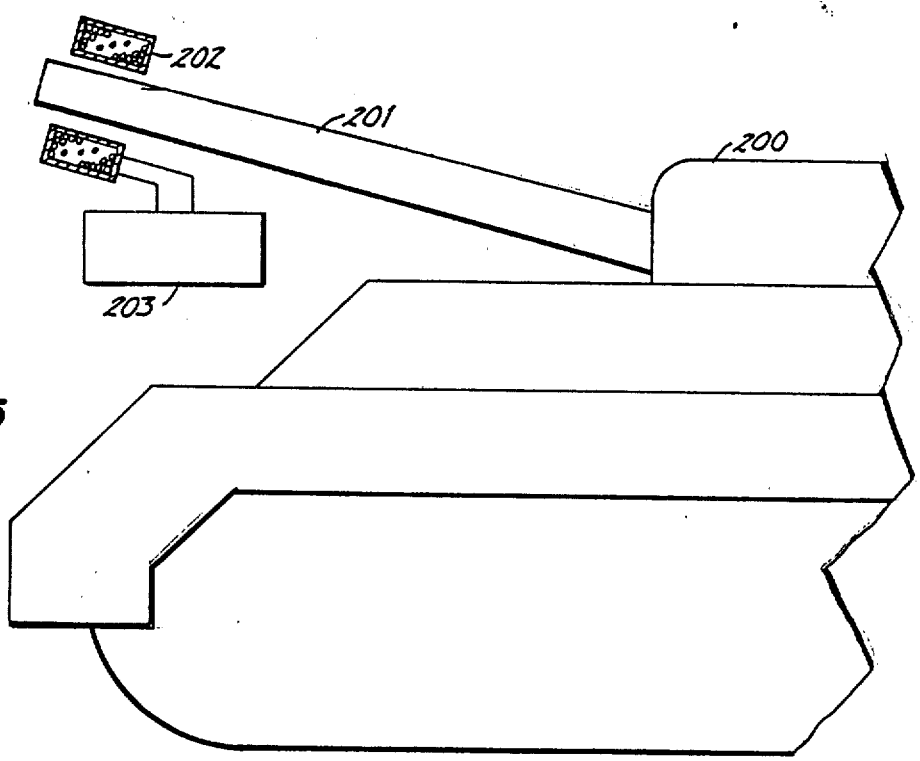
FIG. 15 is a schematic representation of magnetically treating a large gun barrel.

In FIG. 15, a schematic illustration of use of a magnetic coil assembly for relieving the stress in large gun barrels both during and after firing is shown. For example, a tank 230 that has a gun barrel 231 extended from a turret can be treated with a portable magnet coil 232 that can be held in place and powered through a portable power pack indicated at 233. The coil is passed down the length of the barrel 201 a number of times in order to relieve stresses in the barrel. The intensity of the magnetic field can be controlled with portable controls as desired, and the coil assembly can be hand held and moved along the barrel or can even be provided with internal rollers that ride on the barrel and permit the coil to roll along the length of the barrel and back up to the outer end of the barrel as desired.

For all suggested types of treatment, the strength of the field can be varied, the magnetic field can be pulsated, and the wave form for the magnetic field can be a square wave, sine wave or saw tooth wave, as well as being intermittent. Suitable controls and a power source are provided to obtain the desired magnetic field profile.

Figure 16:
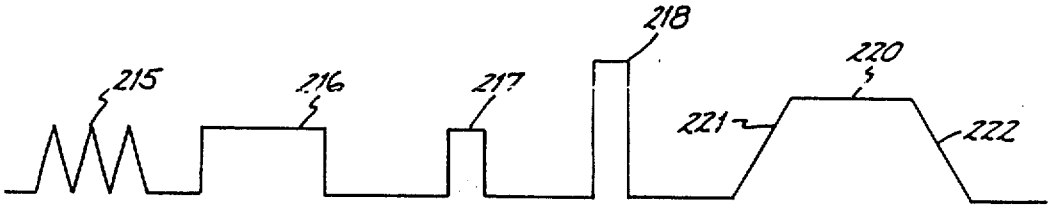
FIG. 16 us a schematic representation of various magnetic field signals useful for treatment according to the present invention.

FIG. 16 shows typical variations in the magnetic field that can be acquired with the appropriate programing for the power supply for electromagnets used. The horizontal line represents time and the vertical scale is the voltage level of the powering signal.

Certain ferromagnetic materials (iron, nickel, carbon steels, low alloy steels, tool steels and some stainless steels) deform elastically when placed in a magnetic field. Magnetostriction causes a specimen made from a ferromagnetic material to change in physical dimensions.

When a magnetic field is applied to a magnetically permeable magnetic conductive material, the magnetization of the material does not change uniformly. Internal magnetization lags the magnetization at the specimens surface. The duration of the lag is influenced by specimen shape, material conductivity, the frequency at which the magnetic field fluctuates, and the material magnetic permeability. During the initial period of magnetization, the skin of the part or specimen experiences the full magnetic field, but the interior does not. Consequently, the outer surface of the part or specimen grows or shrinks, but the core of the specimen remains stable. At the end of a pulse period, the magnetic field will saturate the specimen, if the correct magnetostrictive cycle has been employed.

Because the core and skin of a part respond at different rates to a magnetic field, magnetostriction introduces shear forces into the piece. The shear forces relieve microstresses by causing changes in the crystal structure of the metal. Phase changes can occur because of magnetostriction. Austenite may convert to martensite, for example. Magnetostriction can function like heat treatment or vibration.

The character of the magnetic field is important, as well. The rise time to full field strength and the field collapse time also influence the effectiveness of the process.

Treatable materials include cemented carbides with a cobalt and iron nickel matrix, hot-pressed ceramics such as alumina loaded with nickel and cobalt, brazed tool assemblies and tool steels. Treatment of turbine blades and fasteners can be treated to increase strength and prolong the useful life of the parts. In particular, turbine blades can be treated after installation on a motor or starter to reduce installation stresses. Also turbine blades can be treated as a part of maintenance to relieve accumulated stresses. Treatment of castings, including continuous casting, both in process of pouring and after can be applied to improve diffussion processes, homogenization, reduce internal stresses and improve performance of cast materials, and workability and machineability of castings. High pressure valves and jets can be treated to reduce or prevent crack propogation. Other materials and parts for treatment include piercers, needles, rollers, shaving blades and screens, bearings, bimetals, mine tools and mine tool holders, journals, shafts, threads, bolts, springs, screws, pinions, toothed gearing, chains, chop knives, choppers, kitchen knives, guideways, press tools, battery cans, fiber metal composites, tubing and piping - mechanically drawn and welded, pipe (tube) joints, pipe (tube) lines (for example, for oil transportation, liquid steel transportation, for nuclear station steam and liquid transportation), dental and surgical tools, medical devices, such as valves, pacemakers, steel jacketed discs, and valves.

If the process is used for cutting tools, the work pieces can be metals, including cemented carbides, wood, stone, leather, plastic, concrete, fiber materials, metal fiber compositions, green compacts, including ceramics, and welded seams, by way of example.

What is claimed is:

1. A treatment device for equalizing stress in a drill bit mounted in a drill press for working comprising:

magnet means comprising a coil mounted adjacent such drill press and surrounding a drill bit to be treated, said coil being energized for providing a magnetic field that affects the drill bit held in such drill bit as such drill bit is used, and said magnet means providing a magnetic field of such strength that the stresses are reduced in portions of such drill bit.

2. The device of claim 1 and means to vary the magnetic field as a function of time to cycle the magnetic field acting on such drill bit.

3. The treatment device of claim 1 wherein said drill bit is acting upon a separate part for operations thereon, and separate magnet means creating a magnetic field adjacent said separate part as said drill bit works thereon.

4. A process of treating a ferromagnetic material part for stress relief comprising the steps of:

providing an open center coil energized to provide a magnetic field of desired strength and duration;

placing the part in the open center of the coil in the influence of the magnetic field, and cycling the voltage to change the magnetic field as a function of time for a sufficient total time to cause magnetrostrictive action to redistribute stresses in such part; and subjecting such part to a working operation at the same time as the method of treating is being carried out.

5. The method of claim 4 and including the step of elevating the temperature of the material while the material is subjected to the magnetic field.

6. A treatment device for equalizing stress in a piece part while it is being machined comprising:

magnet means providing a magnetic field in location adjacent to a part to be treated, said magnet means providing a magnetic field of such strength that the stresses are reduced in portions of the piece part while it is being machined, and comprising a U shaped magnet having poles that are facing each other, and means for mounting the magnet with the piece part between the poles as machining operations are performed on the piece part.

7. The apparatus as specified in claim 12 wherein said control means includes means to provide demagnetization of an object such as a cutting tool in said tray.

8. A treatment device for equalizing stress in a part comprising:

magnet means providing a magnetic field in location adjacent to a part to be treated, said magnet means providing a magnetic field of such strength that the stresses are reduced in portions of the part, wherein said magnet means comprises a cup-shaped magnet having a central pole, and a peripheral rim-type pole, and means to support a toroidal ring shaped part around said central pole within the wall of said cup-shaped magnet.

9. A treatment device for equalizing stress in a part comprising:

magnet means providing a magnetic field in location adjacent to a part to be treated, said magnet means providing a magnetic field of such strength that the stresses are reduced in portions of the part, wherein said part comprises a rotatably mounted part on which a grinding wheel is operating, means for mounting the magnet means adjacent such part, and wherein said magnet means comprises electrical coils establishing opposite polarity magnetic poles on opposite sides of such rotatably mounted part during grinding operations thereon.

10. A treatment device for equalizing stress in a part comprising:

magnet means providing a magnetic field in location adjacent to a part to be treated, said magnet means providing a magnetic field of such strength that the stresses are reduced in portion of the part, wherein said part comprises an elongated wire being drawn through a die, and said magnet means comprises an electromagnet positioned adjacent to said die and adjacent to a wire in the die to apply the magnetic field to both said wire and said die during formation, said electromagnet being energized while the wire is being drawn through the die to reduce stresses in the wire and die.

11. A treatment device for equalizing stress in a part comprising:

magnet means providing a magnetic field in location adjacent to part to be treated, said magnet means providing a magnetic field of such strength that the stresses are reduced in portions of the part, wherein said part comprises a gun barrel, and said magnet means comprises a portable coil that surrounds the gun barrel, means for energizing the portable coil, said portable coil being movable along the gun barrel while the coil is energized to provide the magnetic field to reduce stresses in the gun barrel;

12. A treatment devise for increasing the effective service life of objects subjected to stress by stress equalization wherein the object is made of a material influenced by a magnetic field, comprising:

a coil having an open center core;

means for supporting an object to be treated in said open center of the core; and power means for cycling current through said coil to provide a magnetic field in the vicinity of the object to be treated for a selected duration to reduce stresses in such object, said power means including power control means for providing a sequence of applying current to the coil for periods ranging in time from substantially 15 to 50 seconds, in time related cycles, separated by a time pause of no current between each two cycles of current.

13. The apparatus of claim 12 wherein said means for placing comprising support tray having a receptacle for receiving an object slidable into the open center of said core.

14. The apparatus of claim 12 wherein said means for supporting comprising means to rigidly hold said object at a position eccentric from the central axis of said core to provide for magnetostrictive bending of said object during the application of current to the coil.

15. A method of treating magnetic material objects, such as machine tool bits, for stress relief comprising the steps of:

providing a magnetic field of desired strength and pulsing the magnetic field in a plurality of magnetic field pulses separated by a time of not providing magnetic field for selected time durations; and placing an object in the influence of the magnetic field for a sufficient time to subject the object to a plurality of pulses of magnetic field to cause magnetostrictive action to redistribute stresses in such object.

16. The method of claim 15 including the step of damagnetizing the object subsequent to the time of completion of the step of placing.

17. The method of claim 15 including the step of applying voltage to an open center coil to provide the magnetic fields, placing said object within the open center of the coil, and cycling the voltage to the coil for a selected time to provide for stress redistribution in the object.

18. The method of claim 17 including the step of providing silicon control rectifiers for controlling the power to said coil.

19. The method of claim 15 wherein the sufficient time for treatment of said tool is in the range of 15 to 50 seconds.

20. The method of claim 15 including the step of stopping the magnetostrictive action while the object remains magnetized.

21. A treatment apparatus for objects in which magnetostrictive forces are generated from application of magnetic fields thereto in a treatment cycle comprising:

coil means for generating a magnetic field as a function of current through the coil;

means for supporting an object to be treated in the magnetic field generated by current through the coil;

power means for providing current to said coil; and controller means coupled to the power means for controlling the current to the coil and thus the magnetic field of the coil to provide such magnetic field for a plurality of short time durations separated by a time of substantially no current to the coil for each treatment cycle.

22. The treatment apparatus of claim 21 wherein the controller means includes means to control the duration of current to the coil into pulses that are in the range of 15 to 50 seconds in length, separated by a time of no current.

23. The treatment apparatus of claim 21 wherein said coil comprises a substantially open center coil, and the object to be treated is placed within the open center of the coil during the operation of the power means.

24. The treatment apparatus as specified in claim 23 wherein said object comprises a machine tool bit comprising a ferromagnetic material which is subjected to stresses from sharpening and use prior to treatment in the treatment apparatus.

25. A treatment device for increasing the effective service life of objects subjected to stress by stress equalization wherein the object is made of a material influenced by a magnetic field, comprising:

means for providing a magnetic field having a sufficient strength to affect stresses in the object;

means for supporting an object to be treated so as to be affected by the magnetic field at preselected times; and means for cycling the magnetic field effect on the object to be treated in a plurality of time-related magnetic field effect pulses of selected duration to reduce stresses in the object, and said means for cycling including means for providing a time between magnetic field effect pulses when substantially no magnetic field effect is present on the object.

26. A treatment apparatus for objects in which magnetostrictive forces are generated thereon from application of magnetic fields thereto in a treatment cycle comprising:

means for providing a magnetic field;

means for supporting an object to be treated in position for the magnetic field to affect the object; and means for controlling the magnetic field effect on the object to provide such magnetic field to the object for a plurality of preselected separated durations of magnetic field separated by a time when substantially no magnetic field affects the object during each treatment cycle.

* * * * *

UNITED STATES PATENT AND TRADEMARK OFFICE

CERTIFICATE OF CORRECTION

PATENT NO. : 4,873,605

DATED : October 10, 1989

INVENTOR(S) : Vladimir Drits et al.

It is certified that error appears in the above-identified patent and that said Letters Patent is hereby corrected as shown below:

Column 13, line 22, delete "placing comprising" and insert --supporting comprises a--.

Column 13, line 43, delete "damagnetizing" and insert --demagnetizing--.

Column 13, line 47, delete "fields," and insert --field,--.

Signed and Sealed this

Thirty-first Day of July, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,873,605

DATED : October 10, 1989

INVENTOR(S) : Vladimir Drits et al.

It is certified that error appears in the above-identified patent and that said Letters Patent is hereby corrected as shown below:

The sheets of drawing consisting of figures 8-16 should be added as per attached sheets.

Signed and Sealed this

Fourth Day of September, 1990

*Attest:*

HARRY F. MANBECK, JR.

*Attesting Officer*

*Commissioner of Patents and Trademarks*